US011965384B2

(12) United States Patent
Arsoski

(10) Patent No.: US 11,965,384 B2
(45) Date of Patent: Apr. 23, 2024

(54) VARIABLE STIFFNESS CENTRALIZER

(71) Applicant: DOWNHOLE PRODUCTS LIMITED, Aberdeen (GB)

(72) Inventor: Darko Arsoski, Angus (GB)

(73) Assignee: DOWNHOLE PRODUCTS LIMITED

( * ) Notice: Subject to any disclaimer, the term of this patent is extended or adjusted under 35 U.S.C. 154(b) by 0 days.

(21) Appl. No.: 17/918,990

(22) PCT Filed: Mar. 22, 2022

(86) PCT No.: PCT/IB2022/052612

§ 371 (c)(1),
(2) Date: Oct. 14, 2022

(87) PCT Pub. No.: WO2022/201028

PCT Pub. Date: Sep. 29, 2022

(65) Prior Publication Data

US 2023/0235630 A1 Jul. 27, 2023

Related U.S. Application Data

(60) Provisional application No. 63/165,234, filed on Mar. 24, 2021.

(51) Int. Cl.
*E21B 17/10* (2006.01)

(52) U.S. Cl.
CPC ..... *E21B 17/1028* (2013.01)

(58) Field of Classification Search
CPC ..... E21B 17/1021; E21B 17/1028
See application file for complete search history.

(56) References Cited

U.S. PATENT DOCUMENTS 2,727,576 A * 12/1955 Hall ..... E21B 17/1028 166/241.6
4,531,582 A * 7/1985 Muse ..... E21B 17/1028 166/172
4,641,776 A * 2/1987 Vlasek ..... E21B 17/1028 228/155
4,787,458 A 11/1988 Langer
6,102,118 A * 8/2000 Moore ..... E21B 17/1028 405/262

(Continued)

FOREIGN PATENT DOCUMENTS

CN 205654309 U 10/2016
CN 116163663 A * 5/2023
WO 2020/215534 A1 10/2020

OTHER PUBLICATIONS

Eurasian Office Action dated Apr. 12, 2023 for EA 202292614.
Lieu, D.K., Fundamentals of the Design of Olympic Recurve Bows, journal, 2012, University of California, Berkeley.

*Primary Examiner* — Jennifer H Gay

(57) ABSTRACT

A centralizer for use in a wellbore includes a body for disposing around a periphery of a downhole tubular. The body has a plurality of bow springs biased toward an expanded position and a pair of end rings connecting the bow springs. The centralizer further includes an indentation or row of indentation segments formed in a surface of and along each bow spring. The indentations or indentation segments are operable to reduce a stiffness of the centralizer as the bow springs move from the expanded position to a restricted position.

20 Claims, 8 Drawing Sheets

(56) References Cited

U.S. PATENT DOCUMENTS

| | | | | |
|---|---|---|---|---|
| 6,997,254 | B2 | 2/2006 | Jenner | |
| 8,196,670 | B2 | 6/2012 | Jenner | |
| 9,556,687 | B2 * | 1/2017 | Buytaert | E21B 17/1028 |
| 10,156,103 | B2 | 12/2018 | Kirk | |
| 11,459,834 | B2 * | 10/2022 | Kirk | E21B 17/1078 |
| 11,555,357 | B2 * | 1/2023 | Kirk | E21B 17/1028 |
| 2015/0047855 | A1 * | 2/2015 | Buytaert | E21B 17/1078<br>166/241.6 |
| 2017/0260816 | A1 * | 9/2017 | Martin | E21B 17/1014 |
| 2020/0408050 | A1 * | 12/2020 | Kirk | E21B 17/1028 |
| 2022/0010631 | A1 * | 1/2022 | Kirk | E21B 17/1028 |
| 2023/0235630 | A1 * | 7/2023 | Arsoski | E21B 17/1028<br>166/380 |

* cited by examiner

VARIABLE STIFFNESS CENTRALIZER

BACKGROUND OF THE DISCLOSURE

Field of the Disclosure

The present disclosure generally relates to a variable stiffness centralizer.

Description of the Related Art

U.S. Pat. No. 4,787,458 discloses a spring bow with a contact angle reduction member, a centralizer with such a bow, and methods for their use. The centralizer bow has a contact angle reduction member for affecting and reducing the angle of contact between the centralizer bow and the edge of an opening into which a centralizer with the bow is inserted. A spring bow with a tubular abutment member, a centralizer with such a bow and methods for their use. The centralizer bow has a tubular abutment member for affecting and increasing the bow restoring force. A spring bow with both a contact angle reduction member and a tubular abutment member, a centralizer with such a bow, and methods for their use.

U.S. Pat. No. 6,997,254 discloses a spring centralizer device for supporting a tubular member spaced from the wall of a bore is made from a single piece of boron steel material. The spring centralizer device has first and second collars spaced apart along a longitudinal axis. Spring bow portions extend between the collars. As the device is made from a single piece of material, the material extends seamlessly from each collar portion through the bow portions so that there are no joins or points of weakness. Use of boron steel means that the device can be made by cold forming.

U.S. Pat. No. 8,196,670 discloses a stop collar or like device is formed in one piece to have a portion for a tool to be attached. Movement of the tool allows the collar to be drawn tightly into engagement onto a pipe or other tubular member. A bow centralizer has alternate bows longitudinally offset to reduce initial insertion force. The centralizer may be formed to have end bands of the type used in the stop collar.

U.S. Pat. No. 10,156,103 discloses a centralizer including two collars that are connected by asymmetric spring bows. The spring bows each comprise two arcs, where the curvature of one arc is inverted with respect to the curvature of the other arc, one being concave and the other convex. The spring bows are in sets that are equidistantly spaced around the circumference of the collars, each set having the same configuration, and the opposite configuration to the spring bows in the other set. Upon insertion into a wellbore, one set of spring bows is therefore compressed before the other set. Upon compression, the deformation of the concave arc leads to mutual deformation of the convex arc, and the spring bows adopt a flatter configuration, enhancing the rotational freedom of the tubular.

US 2017/0260816 discloses a centralizer including longitudinally spaced collars connected by a plurality of springs, each of the springs including two or more bow sections.

US 2020/0408050 discloses a centralizer including a number of members extending between two collars for mounting the centralizer on a casing. The members are configured to contact a wall of the bore and centralizer the casing in the bore. The members are radially moveable between the casing and the bore wall. The members further include an intermediate portion and end portions, the end portions being relatively more flexible than the intermediate portion.

WO 2020/095050 discloses a centralizer for use in centralizing tubing in a bore comprises a first end collar, a second end collar and a number of elongate strut members. The strut members are interposed between the first end collar and the second end collar and are circumferentially arranged and spaced around the first end collar and second end collar. The strut member have a first end portion, a second end portion, an intermediate portion and angled wing portions which extend from the intermediate portion.

WO 2020/215534 discloses a centralizer including an upper end ring and a lower end ring having uniform diameters. A plurality of working rib plates are affixed in between the upper end ring and the lower end ring. The working rib plates are evenly distributed surrounding the circumference of the upper end ring or the lower end ring. The width of the working rib plates is between 30 and 130 mm. Further comprised are a plurality of stress-relieving grooves. On the basis of actual usage requirements, the stress-relieving grooves are opened in working rib plates of different widths, and in the places of connection between the working rib plates and the upper and lower end rings. When the working rib plates experience extreme compressional deformation, said stress-relieving grooves provide a main body elastic material with space for stress deformation, thereby preventing the organizational structure of a main body elastic material from being broken or partially damaged.

The paper entitled "Fundamentals of the Design of Olympic Recurve Bows", having the first named author Lieu, D. K., and the first named publisher University of California, Berkeley discloses that modern materials and fabrication methods offer new opportunities to redesign competition recurve bows. Through improved bow geometry and proper construction methods, designs can be created which propel arrows with greater energy and efficiency, smoothness on the draw, and stability than before. This paper outlines the physics of bow behavior, and how desirable performance characteristics can be quantified. Also examined is how changing the bow geometry, new materials, and construction techniques can lead to improve bow performance. Recommendations are forwarded on how target bows can be redesigned for better performance in the future.

SUMMARY OF THE DISCLOSURE

The present disclosure generally relates to a variable stiffness centralizer. In one embodiment, a centralizer for use in a wellbore includes a body for disposing around a periphery of a downhole tubular. The body has a plurality of bow springs biased toward an expanded position and a pair of end rings connecting the bow springs. The centralizer further includes an indentation or row of indentation segments formed in a surface of and along each bow spring. The indentations or indentation segments are operable to reduce a stiffness of the centralizer as the bow springs move from the expanded position to a restricted position.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
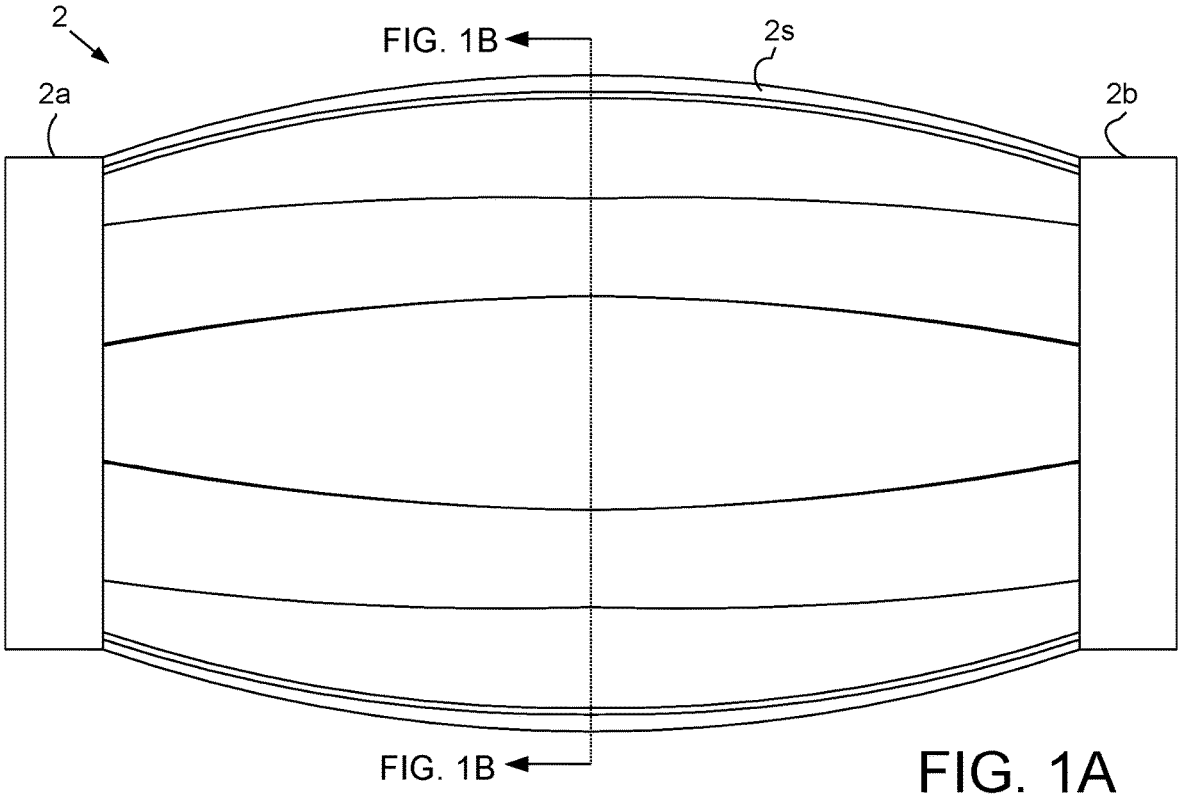
FIGS. 1A-1C and 2A illustrate a variable stiffness centralizer, according to one embodiment of the present disclosure.
Figure 1B:
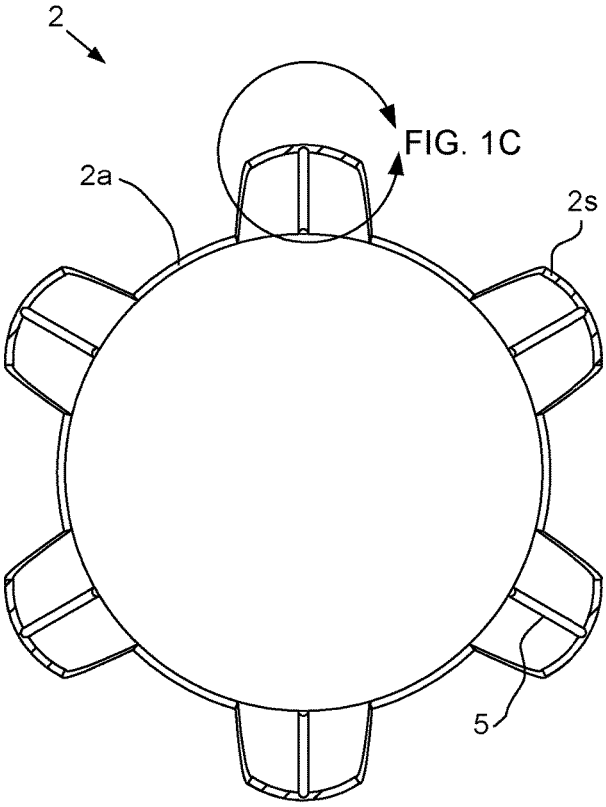
Figure 1C:
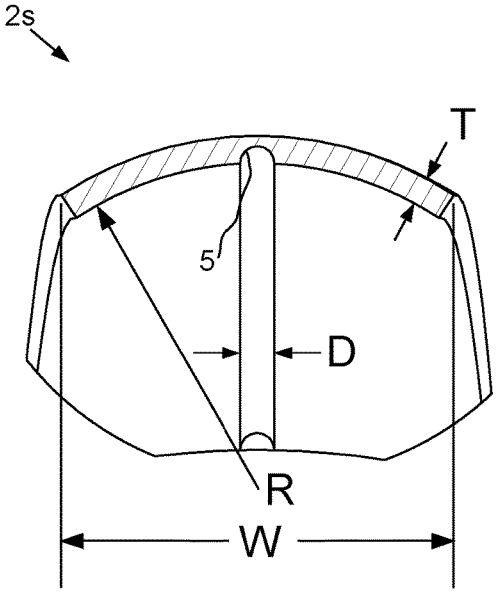
Figure 2A:
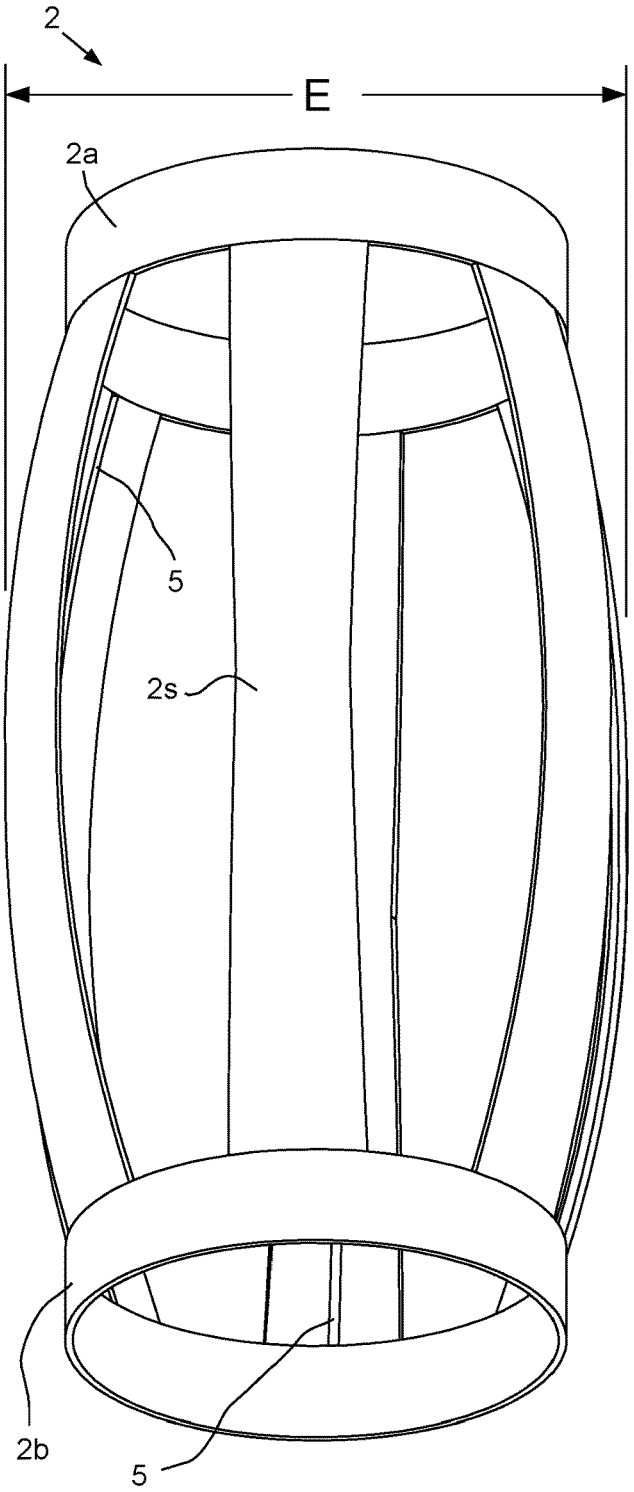
Figure 2B:
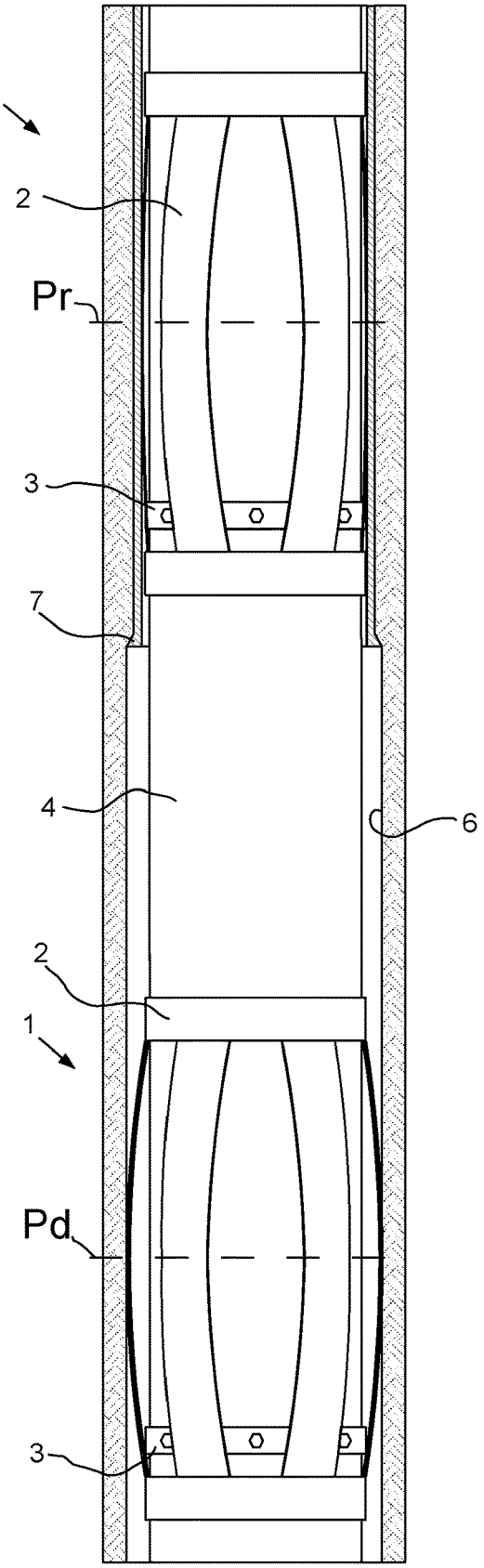
FIG. 2B illustrates a downhole tubular equipped with a plurality of variable stiffness centralizers and being lowered into a wellbore.

FIGS. 1A-1C and 2A illustrate a variable stiffness (aka spring rate) centralizer 1 (FIG. 2B), according to one embodiment of the present disclosure. The centralizer 1 may include a body 2 and a stop collar 3 (FIG. 2B) for coupling the body to a downhole tubular 4 (FIG. 2B), such as a casing or liner string. The body 2 may have a pair of end rings 2*a,b* and a plurality of bow springs 2*s* extending therebetween. The end rings 2*a,b* may connect the bow springs 2*s* together. The bow springs 2*s* may be spaced around the body 2 at regular intervals, such as six bow springs spaced at sixty-degree intervals. Bypass passages may be formed between the bow springs 2*s* to accommodate fluid flow through an annulus formed between the downhole tubular 4 and the wellbore 6 (FIG. 2B). The bow springs 2*s* may each be identical and radially movable between an expanded position Px (shown and FIG. 3A), a restricted position Pr (FIG. 2B), and a deployed position Pd (FIG. 2B). An effective diameter E of the centralizer 1 may be greatest at the expanded position Px, least at the restricted position Pr, and intermediate at the deployed position Pd.

Alternatively, the deployed position Pd may be the position at the 67% standoff ratio, as discussed by the current version of American Petroleum Institute (API) Specification 10D, entitled "Specification for Bow-Spring Casing Centralizers".

The bow springs 2*s* may each have a parabolic profile in the expanded position Px. Each bow spring 2*s* may have a convex arcuate cross-section and a variable width W. The width W of each bow spring 2*s* may be a maximum at each junction with the respective end ring 2*a,b* and may be a minimum at a center thereof. The width W of each bow spring 2*s* may taper between the respective maximum and the minimum widths thereof. The variable width W of each bow spring 2*s* may be due to the cross section of each bow spring having a variable radius of curvature R which may be a maximum at each junction with the respective end ring 2*a,b* and a minimum at the center thereof. In the expanded position Px and at the center of each bow spring 2*s*, the radius of curvature R of the cross section of each bow spring 2*s* may range between twenty percent and forty percent of a radius of each end ring 2*a,b*.

To effectuate variable stiffness, each bow spring 2*s* may be pre-weakened by an indentation 5 formed in an inner surface thereof and extending along a length thereof between the end rings 2*a,b*. Each indentation 5 may be a groove extending into the respective bow spring 2*s*, but not through it, such that a diameter D of each groove may range between fifty percent and one hundred seventy-five percent of a thickness T of the respective bow spring.

The body 2 may longitudinally extend when moving from the expanded position Px to either of the restricted position Pr or the deployed position Pd and longitudinally contract when moving from either of the restricted position or the deployed position to the expanded position. The bow springs 2*s* may be naturally biased toward the expanded position Px and the effective diameter E of the centralizer 1 at the deployed position Pd may correspond to a diameter of a portion of a wellbore 6 to which the centralizer will be deployed. Engagement of the bow springs 2*s* with a wall of the wellbore 6 may move the downhole tubular 4 toward a central position within the wellbore to ensure that a uniform cement sheath is formed around the downhole tubular during a cementing operation (not shown). The body 2 may be formed from a single sheet of a metal or alloy, such as steel (i.e., spring steel) by cutting out slots to form strips which will become the bow springs 2*s*. The body 2 may be formed into a tubular shape by rolling the cut sheet and welding seams of the end rings 2*a,b* together. The bow springs 2*s* may have the natural bias toward the expanded position Px and the arcuate cross section by being held therein during heat treatment of the body 2.

The stop collar 3 may be located between the end rings 2*a,b* by insertion through one of the slots between the bow springs 2*s* before the centralizer 1 is slid over the periphery of the downhole tubular 4. The stop collar 3 may be mounted to the downhole tubular 4 using a plurality of fasteners, such as set screws. Setting of the stop collar 3 may trap the centralizer 1 into place along the downhole tubular 4 while allowing limited longitudinal movement of the body 2 relative thereto to accommodate movement between the positions Px, Pr, Pd.

Alternatively, the centralizer 1 may further include a pair of end collars (not shown). In this alternative, after the body 2 has been formed, each end collar may be inserted into the respective end rings 2*a,b*. Each end collar may be formed to be a tight fit within the end rings 2*a,b*. Each end collar may then be spot-welded to the respective end rings 2*a,b*. A lip of each end ring 2*a,b* extending past the respective end collar may be split into a multitude of tabs (before or after insertion of the collars) and the tabs may be bent over the respective end collar, thereby mounting the collars to the body 2 (in addition to the spot welds).

FIG. 2B illustrates the downhole tubular 4 equipped with a plurality of the variable stiffness centralizers 1 and being lowered into the wellbore 6. An upper section of the wellbore 6 may have been previously drilled and lined with a casing or liner string 7 secured into the wellbore with cement (not shown). A lower section of the wellbore 6 may have then been drilled and underreamed to access a hydrocarbon-bearing formation (not shown). The underreamed lower section of the wellbore 6 may have a diameter greater than an inner diameter of the casing or liner string 7. The lower section of the wellbore 6 may be vertical or deviated, such as inclined or horizontal. The centralizers 1 may each be mounted to the downhole tubular 4 (using the stop collars 3) along at least a portion thereof that will be cemented into the wellbore 6. The centralizers 1 may be spaced along the portion of the downhole tubular 4 at regular intervals. As each centralizer 1 enters the casing or liner string 7, the centralizer will be compressed to the restricted position Pr such that a running force (not shown) is required to lower the respective centralizer therethrough. Once each centralizer passes through and exits the casing or liner string, the centralizer 1 will expand from the restricted position Pr to the deployed position Pd. At the deployed position, the centralizers 1 maintain the neutral position of the downhole tubular 4 to ensure that a uniform cement sheath is formed around the downhole tubular during the cementing operation.

Alternatively, one or more of stop collars 3 may be located outside each centralizer 1, such as a pair of stop collars 3 straddling each centralizer 1, instead of one stop collar being located between the each pair of end rings 2*a,b* and inside the respective centralizer 1.

Figure 3A:
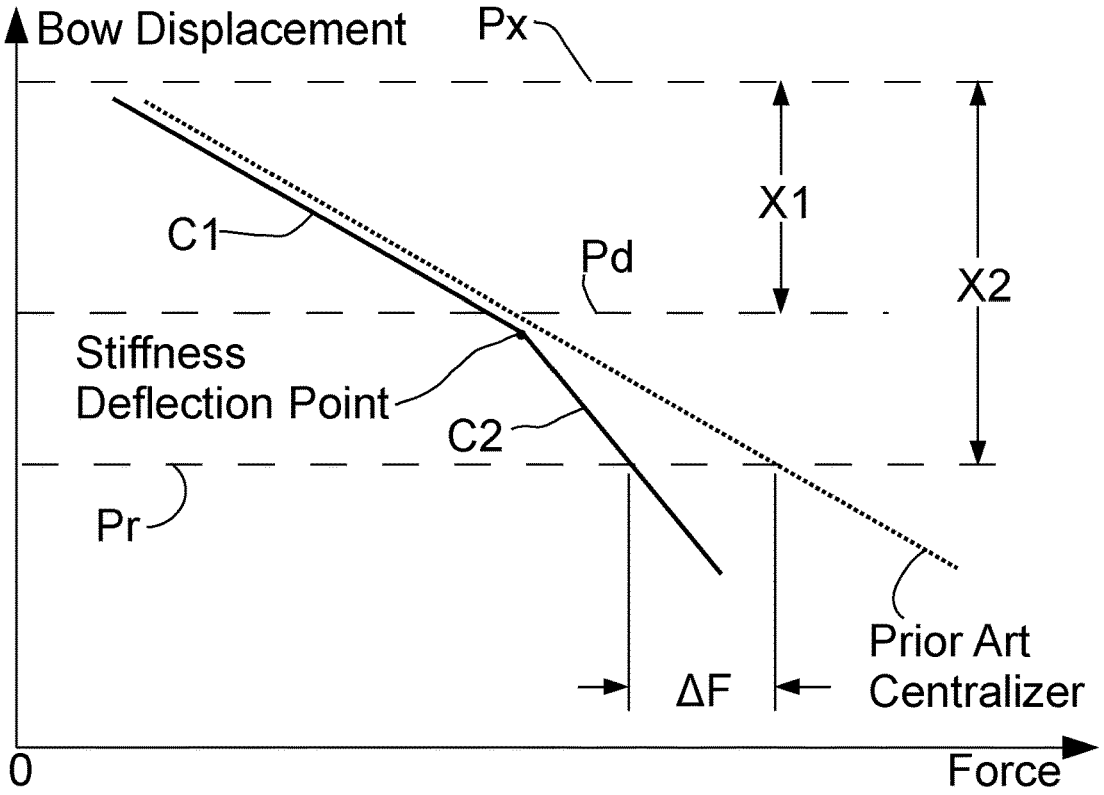
FIGS. 3A and 3B illustrate operation of the variable stiffness centralizer.
Figure 3B:
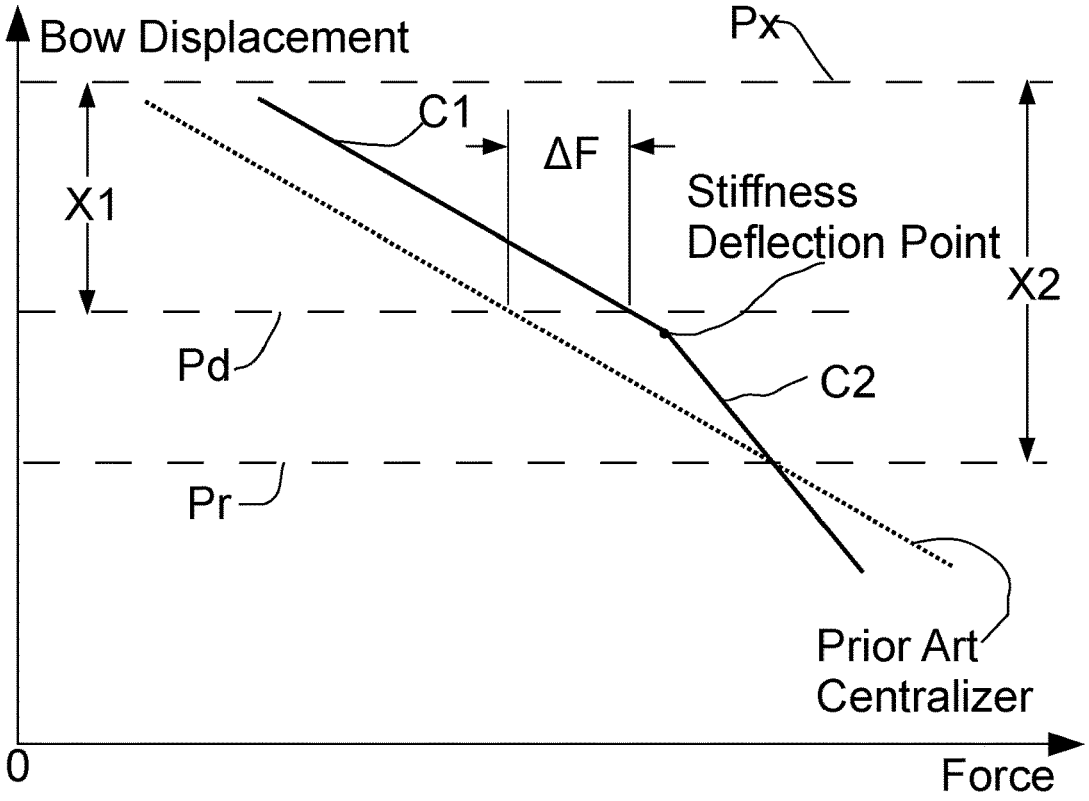

FIGS. 3A and 3B illustrate operation of the variable stiffness centralizer 1. Referring to FIG. 3A and as illustrated by line C1, the centralizer 1 exhibits a conventional force-displacement response when moving from the expanded position Px to the deployed position Pd by the displacement X1. During the motion exhibited along curve C1, the indentation 5 has no effect on the stiffness (slope of C1 equal to the absolute value of force differential divided by bow displacement differential) of the centralizer 1. However, as discussed in detail below, when moving from the expanded position Px to the restricted position Pr (displacement denoted by X2), the indentation 5 begins affecting the stiffness at the stiffness deflection point. Past the stiffness deflection point the force-displacement response of the centralizer 1 is exhibited by line C2 which has a slope significantly less than the slopes of the line C1 and that of the prior art line. The slope of the line C2 may be less than or equal to eighty percent, seventy percent, sixty percent, or fifty percent of the slope of the line C1. The reduced slope of the line C2 results in a force at the restricted position Pr which is significantly less than the force of the prior art, the difference being denoted by ΔF. This force reduction ΔF is proportional (the centralizer force being the normal force component of the frictional running force) to the running force reduction that advantageously results therefrom. Reduction in the running force is advantageous because the running force could otherwise actually exceed the deployment force capability of the downhole tubular 4 (primarily generated by weight thereof) which could obstruct deployment thereof.

Alternatively, the force-displacement response of the centralizer 1 may be non-linear and the stiffness may be measured by line fitting the lines C1, C2 to the non-linear force-displacement response.

Referring to FIG. 3B, instead of utilizing the force reduction ΔF to decrease running force, the centralizer 1 may be designed to have the same force as the prior art centralizer at the restricted position Pr. In this configuration the force reduction ΔF would actually be an increase in restoring force at the deployment position Pd. This increase in restoring force ΔF could advantageously be utilized to reduce the number of centralizers 1 required for the downhole tubular 4 and/or increase the deviation of the wellbore 6.

Alternatively, the centralizer 1 could be configured to be between the positions illustrated in FIGS. 3A and 3B to capture some of the benefits of both.

Figure 4A:
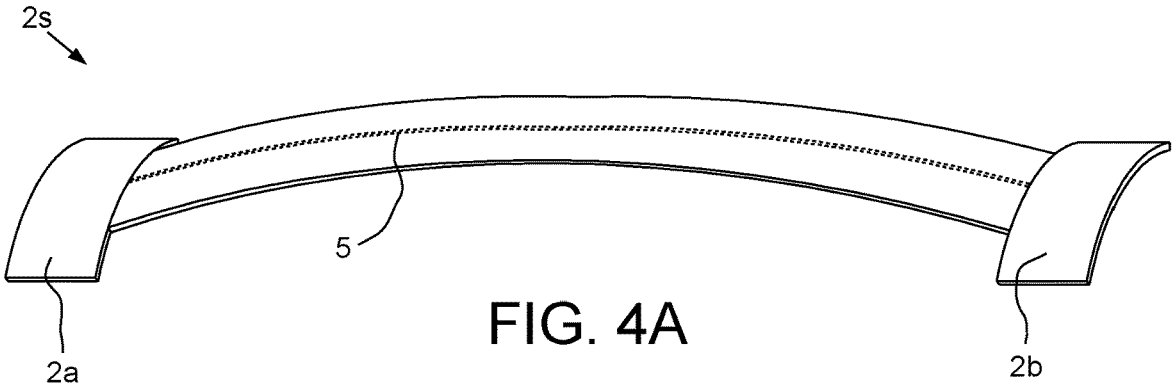
FIG. 4A illustrates a typical bow spring of the variable stiffness centralizer in an expanded position.
Figure 4B:
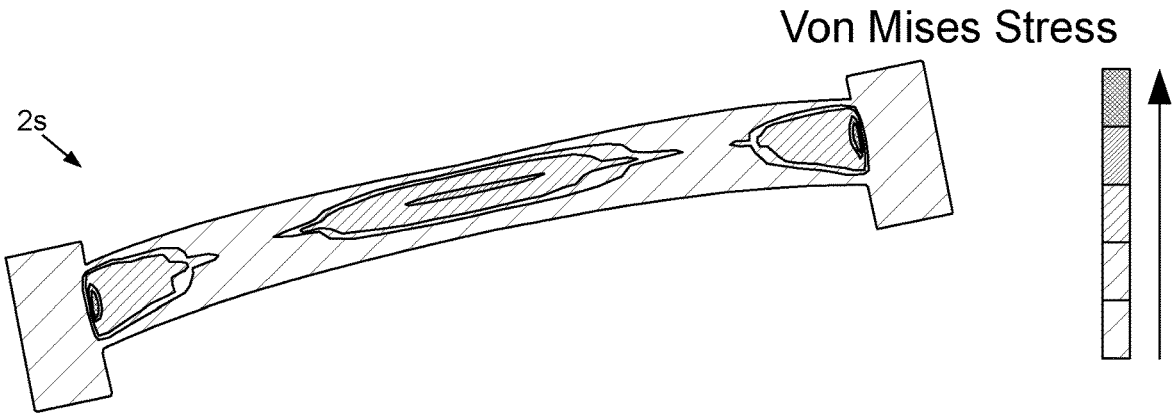
FIG. 4B illustrates a finite element analysis (FEA) of the typical bow spring in a deployed position.
Figure 4C:
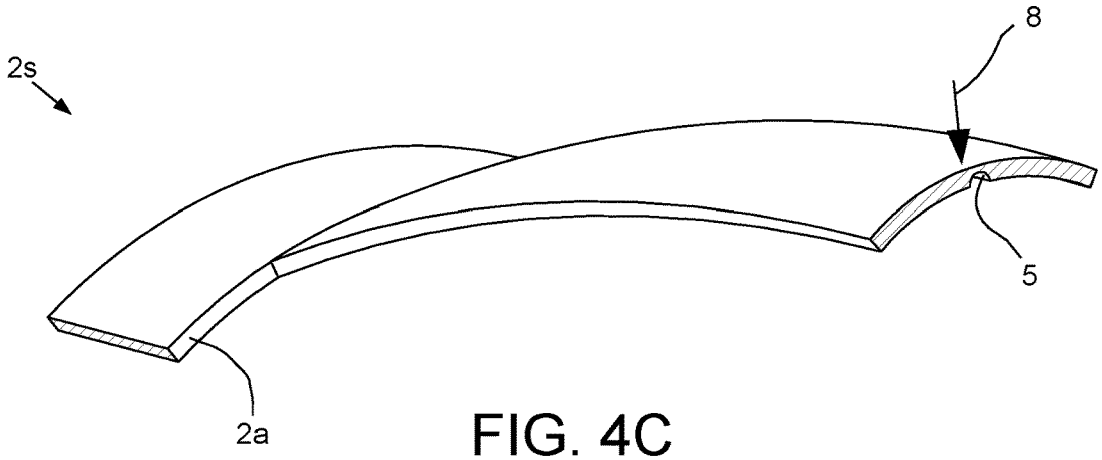
FIG. 4C illustrates deformation of the typical bow spring in the deployed position.
Figure 5A:
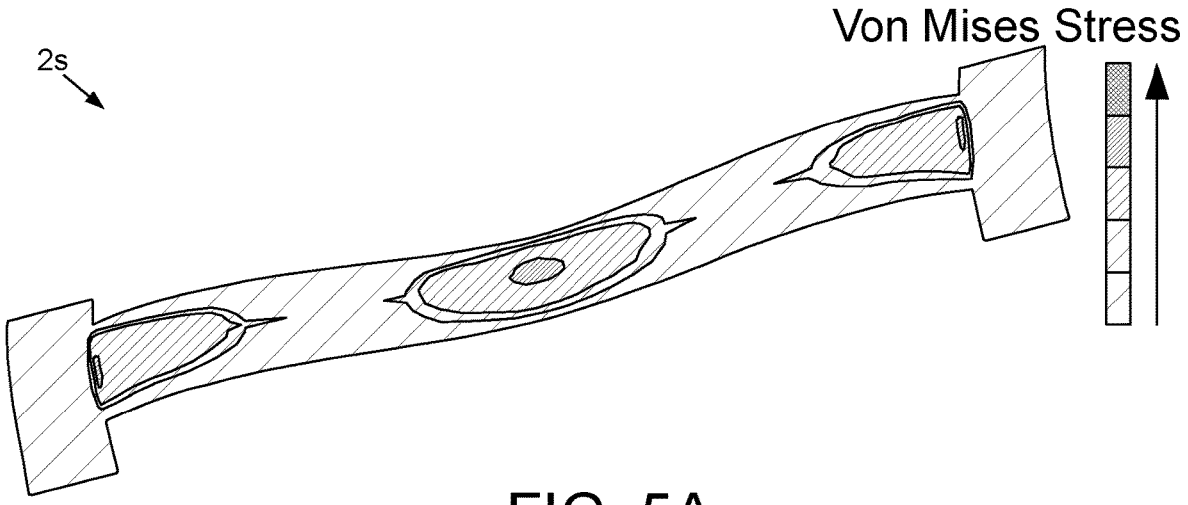
FIG. 5A illustrates the FEA of the typical bow spring in a restricted position.
Figure 5B:
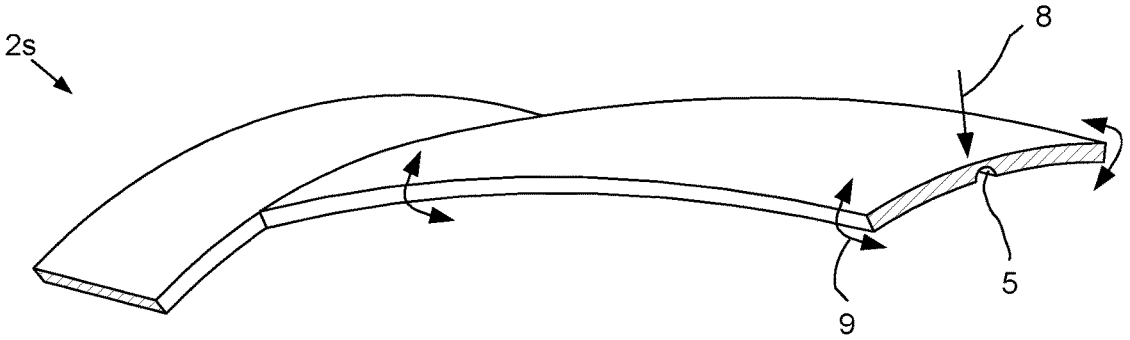
FIG. 5B illustrates deformation of the typical bow spring in the restricted position.

FIG. 4A illustrates a typical bow spring 2*s* of the variable stiffness centralizer 1 in the expanded position Px. FIG. 4B illustrates a finite element analysis (FEA) of the typical bow spring 2*s* in the deployed position Pd. FIG. 4C illustrates deformation of the typical bow spring 2*s* in the deployed position. FIG. 5A illustrates the FEA of the typical bow spring 2*s* in the restricted position Pr. FIG. 5B illustrates deformation of the typical bow spring 2*s* in the restricted position Pr. The indentation 5 divides the cross section of the typical bow spring 2*s* into two half portions. When the typical bow spring 2*s* moves from the expanded position Px to the deployed position Pd, force 8 exerted by the wellbore 6 causes stress concentration at the center of the bow spring and at each junction between the bow spring and the respective end ring 2*a,b* and a slight increase of the radius of curvature R also results. As the typical bow spring 2*s* moves from the expanded position Px to the restricted position Pr, force 8 exerted by the casing or liner string 7 causes the two half portions of the cross section to rotate 9 about the indentation 5, thereby flattening the cross section of the typical bow spring and alleviating the stress concentrations at the center of the bow spring and at each junction between the bow spring and the respective end ring 2*a,b*. The rotation 9 of the two half portions may even go so far as to flip the cross section of the typical bow at the center thereof. This rotation 9 of the two half portions causes the reduction in stiffness of line C2, illustrated and discussed above with reference to FIGS. 3A and 3B.

Additionally, the rotation 9 of the two half portions made possible by the indentation 5 may also reduce insertion force of the centralizer 1 into the casing or liner string 7.

Figure 6A:
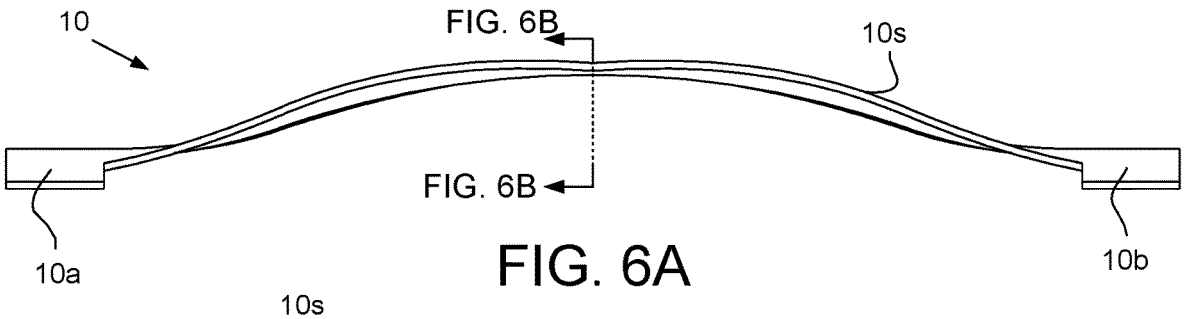
FIGS. 6A and 6B illustrate a typical bow spring of an alternative variable stiffness centralizer in the expanded position, according to another embodiment of the present disclosure.
Figure 6B:
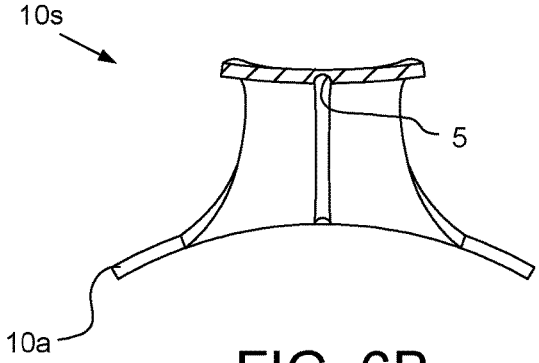
Figure 6C:
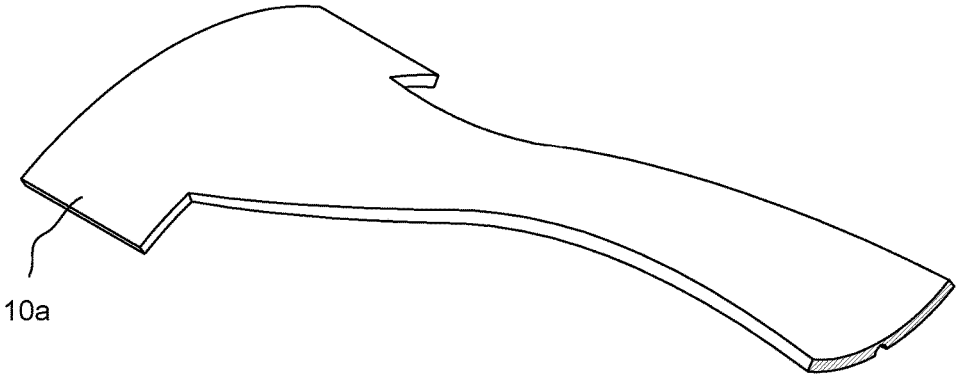
FIG. 6C illustrates deformation of the typical bow spring in the deployed position.

FIGS. 6A and 6B illustrate a typical bow spring 10*s* of an alternative variable stiffness centralizer in the expanded position according to another embodiment of the present disclosure. The centralizer may include a body 10 and the stop collar 3 for coupling the body to the downhole tubular 4. The body 10 may have a pair of end rings 10*a,b* and a plurality of bow springs 10*s* extending therebetween. The end rings 10*a,b* may connect the bow springs 10*s* together. The bow springs 10*s* may be spaced around the body 10 at regular intervals, such as six bow springs spaced at sixty-degree intervals. Bypass passages may be formed between the bow springs 10*s* to accommodate fluid flow through an annulus formed between the downhole tubular 4 and the wellbore. The bow springs 10*s* may each be identical and radially movable between an expanded position Px (shown), a restricted position Pr (FIG. 6D), and a deployed position Pd (FIG. 6C). An effective diameter E of the centralizer may be greatest at the expanded position Px, least at the restricted position Pr, and intermediate at the deployed position Pd.

The bow springs 10*s* may each have a parabolic profile in the expanded position Px. Each bow spring 10*s* may have a concave-convex arcuate cross-section and a variable width W. The width W of each bow spring 10*s* may be a maximum at each junction with the respective end ring 10*a,b* and may be a minimum at one or at a plurality of positions between the end rings. The width W of each bow spring 10*s* may taper between the respective maximum and the minimum widths thereof. The variable width W of each bow spring 10*s* may be due to the cross section of each bow spring having a variable radius of curvature R which may be convex at each junction with the respective end ring 10*a,b* and a concave at the center thereof.

To effectuate variable stiffness, each bow spring 10*s* may be pre-weakened by the indentation 5 formed in an inner surface thereof and extending along a length thereof between the end rings 10*a,b*. Each indentation 5 may be a groove extending into the respective bow spring 10*s*, but not through it, such that a diameter D of each groove may range between fifty percent and one hundred seventy-five percent of a thickness T of the respective bow spring.

The body 10 may longitudinally extend when moving from the expanded position Px to either of the restricted position Pr or the deployed position Pd and longitudinally contract when moving from either of the restricted position or the deployed position to the expanded position. The bow springs 10*s* may be naturally biased toward the expanded position Px and the effective diameter E of the centralizer at the deployed position Pd may correspond to a diameter of a portion of a wellbore 6 to which the centralizer will be deployed. Engagement of the bow springs 10*s* with a wall of the wellbore 6 may move the downhole tubular 4 toward a central position within the wellbore to ensure that a uniform cement sheath is formed around the downhole tubular during a cementing operation. The body 10 may be formed from a single sheet of a metal or alloy, such as steel (i.e., spring steel) by cutting out slots to form strips which will become the bow springs 10*s*. The body 10 may be formed into a tubular shape by rolling the cut sheet and welding seams of the end rings 10*a,b* together. The bow springs 10*s* may have the natural bias toward the expanded position Px and the arcuate cross section by being held therein during heat treatment of the body 10.

Figure 6D:
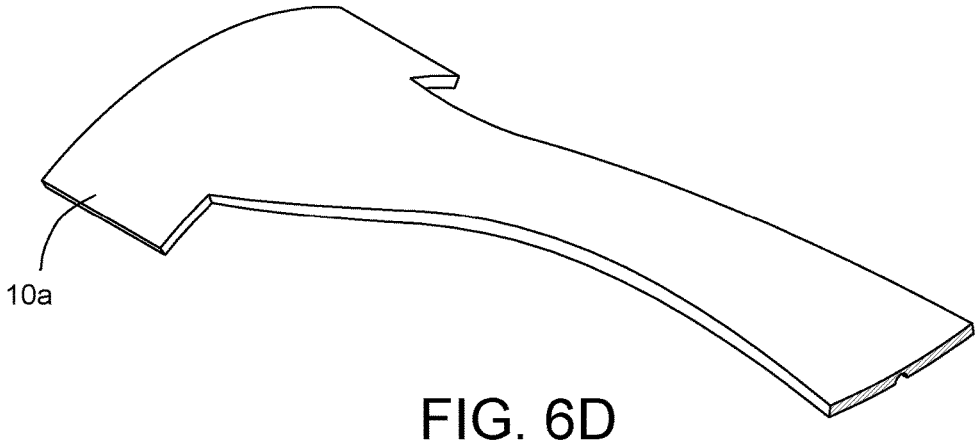
FIG. 6D illustrates deformation of the typical bow spring in the restricted position.
Figure 7A:
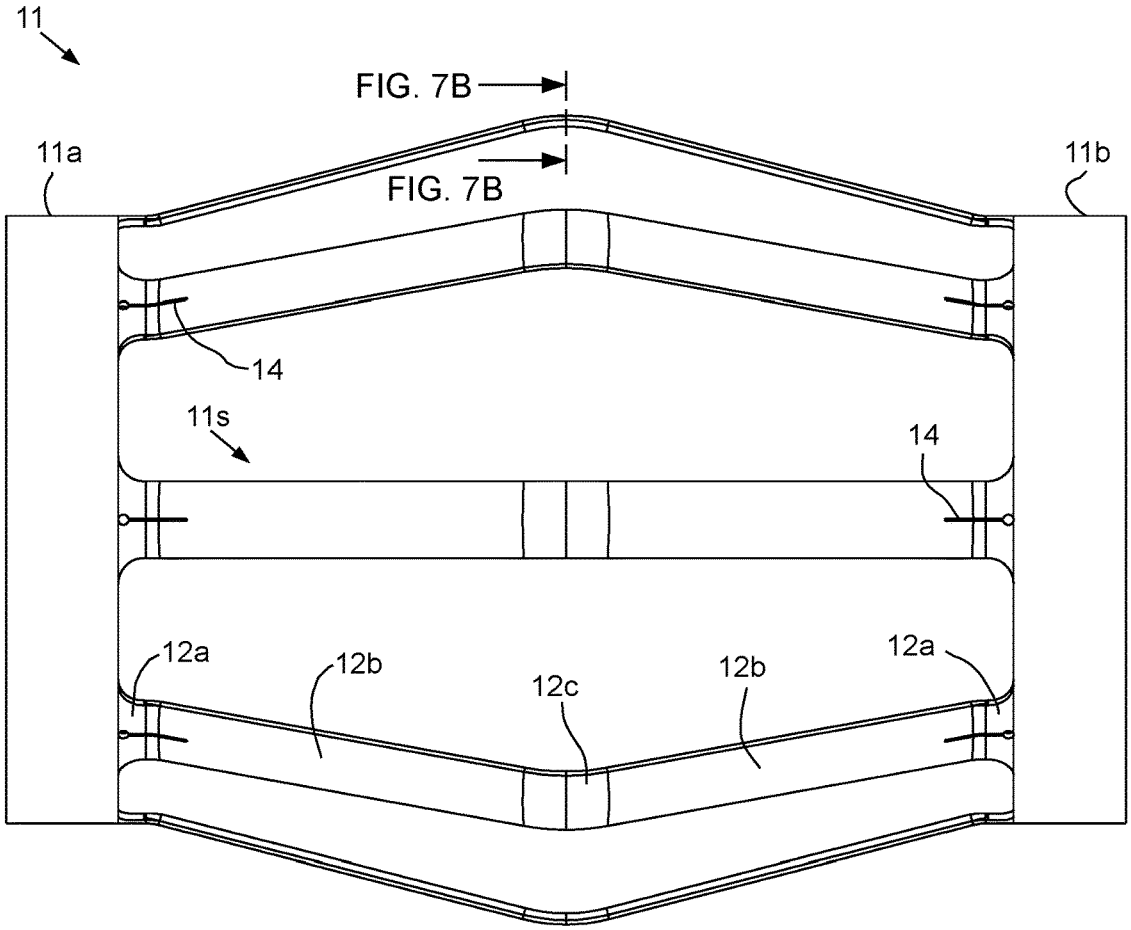
FIGS. 7A, 7B, 8A, and 8B illustrate a second alternative variable stiffness centralizer in the expanded position, according to another embodiment of the present disclosure.
Figure 7B:
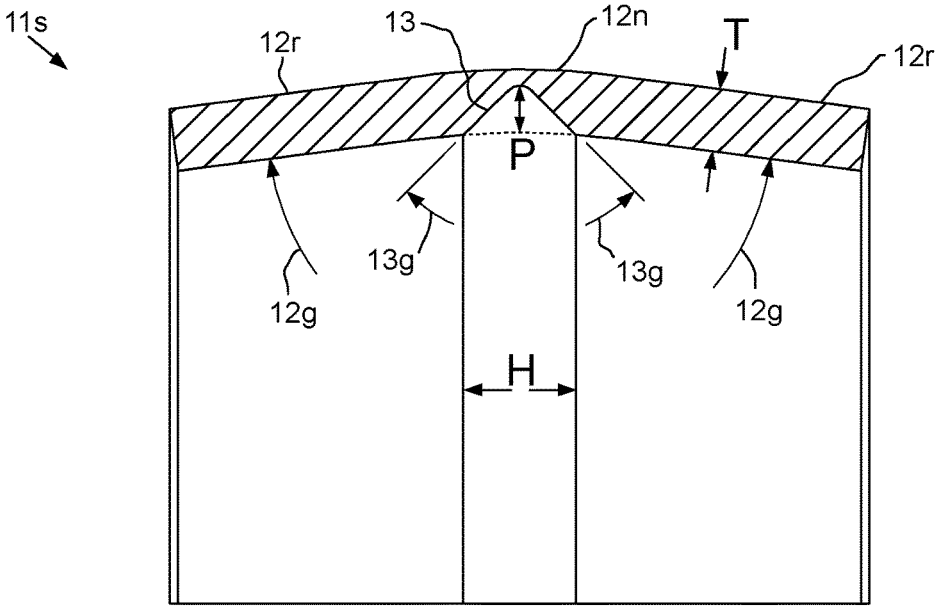
Figure 8A:
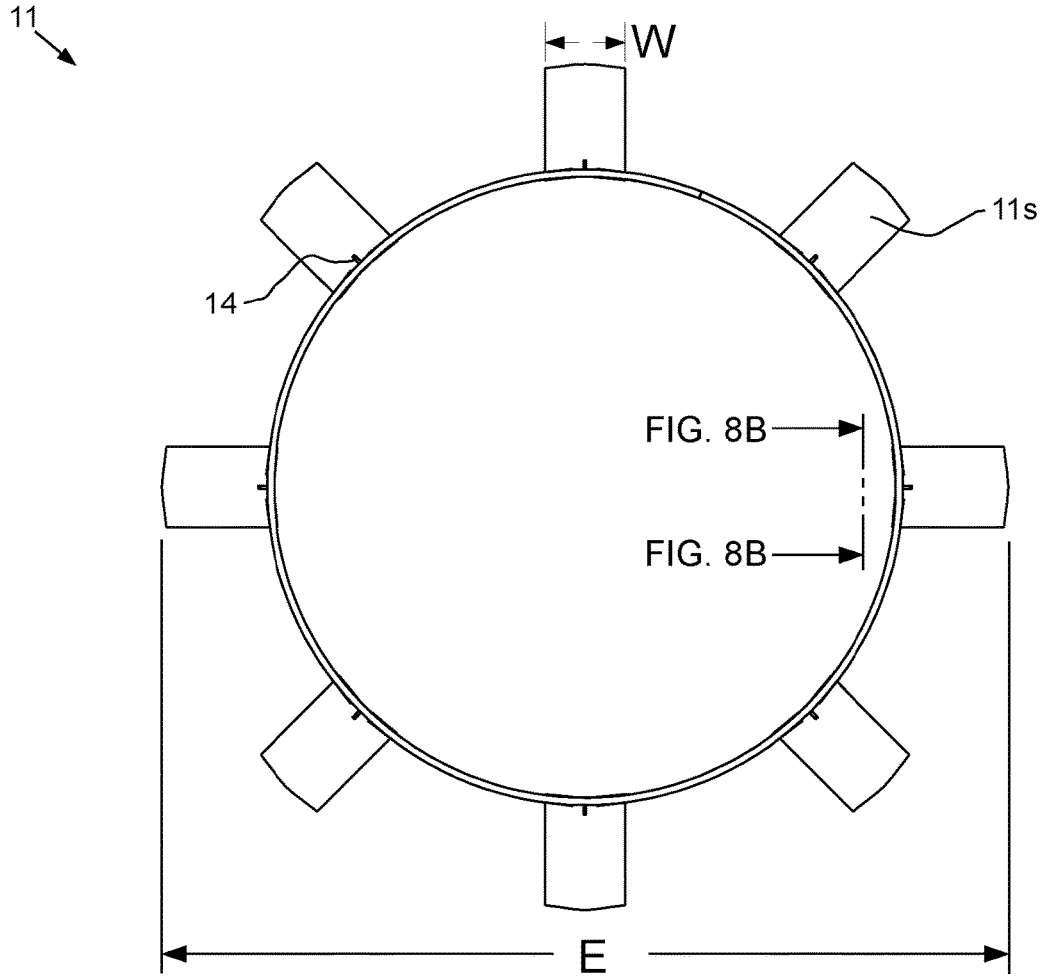
Figure 8B:
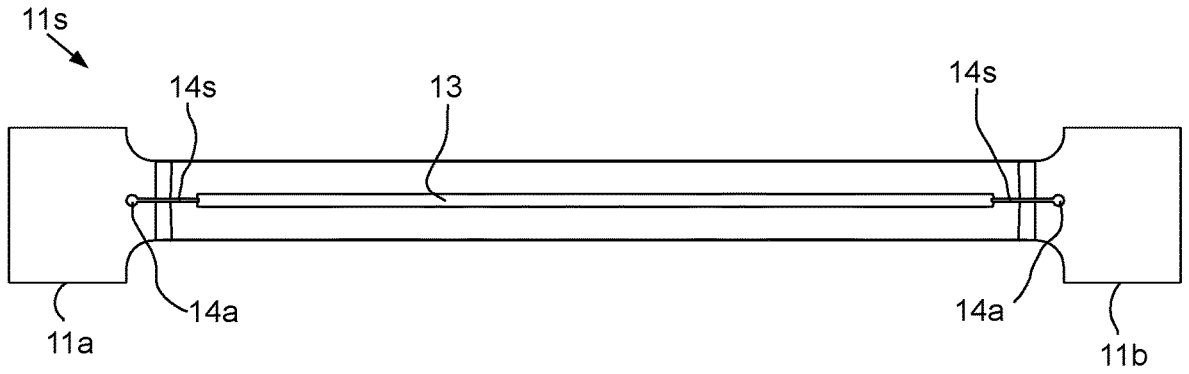

FIG. 6C illustrates deformation of the typical bow 10*s* spring in the deployed position. FIG. 6D illustrates deformation of the typical bow spring 10*s* in the restricted position. The alternative variable stiffness centralizer may exhibit similar force-displacement responses, as illustrated in FIGS. 3A and 3B, and discussed above with reference to the centralizer 1. The indentation 5 of the alternative variable stiffness centralizer may operate in a similar fashion to effectuate variable stiffness, as illustrated above in FIGS. 4B, 4C, 5A, and 5B, and discussed above with reference to the centralizer 1.

FIGS. 7A, 7B, 8A, and 8B illustrate a second alternative variable stiffness centralizer in the expanded position, according to another embodiment of the present disclosure. The second alternative centralizer may include a body 11 and the stop collar 3 (FIG. 2B) for coupling the body to the downhole tubular 4 (FIG. 2B). The body 11 may have a pair of end rings 11*a,b* and a plurality of bow springs 11*s* extending therebetween. The end rings 11*a,b* may connect the bow springs 11*s* together. The bow springs 11*s* may be spaced around the body 11 at regular intervals, such as eight bow springs spaced at forty-five-degree intervals. Bypass passages may be formed between the bow springs 11*s* to accommodate fluid flow through an annulus formed between the downhole tubular 4 and the wellbore 6 (FIG. 2B). The bow springs 11*s* may each be identical and radially movable between an expanded position (shown), a restricted position (not shown, see Pr in FIG. 2B), and a deployed position (not shown, see Pd in FIG. 2B). An effective diameter E of the second alternative centralizer may be greatest at the expanded position, least at the restricted position, and intermediate at the deployed position.

Alternatively, any of the alternatives discussed above for the centralizer 1 may also apply to the second alternative centralizer.

The bow springs 11*s* may each have a polylinear profile in the expanded position. Each bow spring 11*s* may have a pair of linear leg portions 12*b*, a pair of transition portions 12*a* connecting the respective leg portions to the respective end rings 11*a,b*, and a central portion 12*c* connecting the leg portions together. The central portion 12*c* may have a parabolic profile. A length of each leg portion 12*b* may be significantly greater than each of: a length of the central portion 12*c* and a length of each transition portion 12*a*, such as at least twice the length thereof. Each transition portion 12*a* may have a linear and/or concave profile. The leg portions 12*b* and central portion 12*c* of each bow spring 12*s* may have a constant width W. The width W of each transition portion 12*a* may be a maximum at each junction with the respective end ring 11*a,b* and may be a minimum at junction with the respective leg portion 12*b*. The width W of each transition portion 12*a* may flare between the respective maximum and the minimum widths thereof. The profile and/or cross section of each bow spring 11*s* may be symmetric.

The leg portions 12*b* and central portion 12*c* of each bow spring 11*s* may have a convex polylinear cross-section (in the expanded position). To effectuate variable stiffness, each bow spring 11*s* may be pre-weakened by an indentation 13 and a pair of stress reliefs 14. The indentation 13 may be formed in an inner surface of the leg portions 12*b* and central portion 12*c* and may extend along a length thereof almost to the transition portions 12*c*. Each stress relief 14 may extend from a respective end of the indentation 13 to the respective end collar 12*a,b*. Each stress relief 14 may include a slot 14*s* formed through the respective leg portion 12*b* and transition portion 12*a* and an aperture 14*a* formed through the respective transition portion. Each slot 14*s* may extend from a respective end of the indentation 13 and along the respective transition portion 12*a* and each aperture 14*a* may be formed adjacent to the junction of the respective transition portion 12*a* and the respective end ring 11*a,b* and adjacent to the end of the respective slot 14*s*.

Each indentation 13 may be a groove, such as a V-groove, extending into the respective bow spring 11*s*, but not through it, such that a depth P of each groove may range between fifty percent and ninety percent of a thickness T of the respective bow spring. A width H of each groove may range between seventy-five percent and three hundred fifty percent of the thickness T of the respective bow spring. A groove angle 13*g* of the indentation 13 may range between sixty degrees and one hundred twenty degrees. The cross-section of the leg portions 12*b* and central portion 12*c* of each bow spring 11*s* may have a pair of rectangular portions 12*r* and a central arcuate portion 12*n* connecting the rectangular portions together. The indentation 13 may be formed in the arcuate portion 12*n*. An included angle 12*g* between the rectangular portions 12*r* may range from between one hundred twenty and one hundred seventy-five degrees. Each rectangular portion 12*r* may have a width greater than a width of the respective arcuate portion 12*n*.

A diameter of each aperture 14*a* may be significantly greater than a width of the respective slot 14*s*, such as at least twice the width thereof. The width H of each indentation 13 may be greater than the diameter of each aperture 14*a*. A length of the indentation 13 may be significantly greater than a length of each relief 14 such that the indentation extends for most of a length of the respective bow spring 11*s*, such as at least two-thirds or three-fourths thereof.

The body 11 may longitudinally extend when moving from the expanded position to either of the restricted position or the deployed position and longitudinally contract when moving from either of the restricted position or the deployed position to the expanded position. The bow springs 11*s* may be naturally biased toward the expanded position and the effective diameter E of the second alternative centralizer at the deployed position may correspond to a diameter of a portion of the wellbore 6 to which the centralizer will be deployed. Engagement of the bow springs 11*s* with a wall of the wellbore 6 may move the downhole tubular 4 toward a central position within the wellbore to ensure that a uniform cement sheath is formed around the downhole tubular during a cementing operation (not shown). The body 11 may be formed from a single sheet of a metal or alloy, such as steel (i.e., spring steel) by cutting out slots to form strips which will become the bow springs 11*s*. The body 11 may be formed into a tubular shape by rolling the cut sheet and welding seams of the end rings 11*a,b* together. The bow springs 11*s* may have the natural bias toward the expanded position and the polylinear cross section by being held therein during heat treatment of the body 11.

Alternatively, any or all of the typical bows 2*s*,10*s*,11*s* may have the respective indentations 5,13 formed in an outer surface thereof instead of in the inner surface thereof. Alternatively, any or all of the typical bows 2*s*,10*s*,11*s* may have a plurality of the respective indentations 5,13 instead of only one indentation. The plurality of the indentations 5,13 may extend along the respective bow 2*s*,10*s*,11*s* in a parallel fashion or may converge or diverge when moving from each end collar 2*a,b*, 10*a,b*,11*a,b* toward the center of the respective bow. Alternatively, any or all of the typical bows 2*s*,10*s*,11*s* may have a row of indentation segments forming a dashed pattern and extending along a surface thereof instead of the respective (continuous) indentations 5,13.

In another embodiment (not shown), a third alternative variable stiffness centralizer may include one or more of the convex cross-section bow springs 2*s* and one or more of the concave-convex cross-section bow springs 10*s*, such as three of each, arranged in an alternating fashion around the body thereof. In all other respects, the third alternative variable stiffness centralizer may be similar to the centralizer 1.

While the foregoing is directed to embodiments of the present disclosure, other and further embodiments of the disclosure may be devised without departing from the basic scope thereof, and the scope of the invention is determined by the claims that follow.

The invention claimed is:

1. A centralizer for use in a wellbore, comprising:

a body for disposing around a periphery of a downhole tubular, the body having a plurality of bow springs biased toward an expanded position and a pair of end rings connecting the bow springs; and an indentation or row of indentation segments formed in a surface of, but not through a thickness of, each bow spring and operable to reduce a stiffness of the centralizer as the bow springs move from the expanded position to a restricted position, wherein each indentation or indentation segment extends, lengthwise, along a longitudinal axis of the respective bow spring.

2. The centralizer of claim 1, wherein a cross section of each bow spring has a polylinear shape.

3. The centralizer of claim 2, wherein a width of each bow spring is constant except for transition portions at the end rings.

4. The centralizer of claim 2, wherein each bow spring is symmetric.

5. The centralizer of claim 2, wherein:

the cross section of each bow spring has a pair of rectangular portions and a central arcuate portion connecting the rectangular portions together, and each indentation or indentation segment is formed in the respective central arcuate portion.

6. The centralizer of claim 1, wherein each indentation or indentation segment is a groove.

7. The centralizer of claim 6, wherein a depth of each groove ranges between fifty percent and ninety percent of the thickness of the respective bow spring.

8. The centralizer of claim 6, wherein a width of each groove ranges between seventy-five percent and three hundred fifty percent of the thickness of the respective bow spring.

9. The centralizer of claim 6, further comprising a pair of stress reliefs formed through each bow spring, each stress relief extending from a respective end of the respective groove to the respective end ring.

10. The centralizer of claim 1, wherein each indentation or indentation segment is located at a center of the respective bow spring.

11. The centralizer of claim 1, wherein each indentation or indentation segment is formed in an inner surface of the respective bow spring.

12. The centralizer of claim 1, wherein:

the bow springs are further movable to an intermediate deployed position, the centralizer exhibits a first stiffness between the expanded and deployed positions and a second stiffness between the deployed and restricted positions, and the second stiffness is less than or equal to eighty percent of the first stiffness.

13. The centralizer of claim 1, wherein the body is made from steel.

14. The centralizer of claim 1, further comprising a stop collar for coupling the centralizer to the downhole tubular.

15. A method of deploying a downhole tubular into a wellbore, comprising:

assembling the centralizer of claim 1 with the downhole tubular; and lowering the downhole tubular through a restriction in the wellbore.

16. The centralizer of claim 1, wherein a cross section (transverse to the length) of each bow spring is convex.

17. A centralizer for use in a wellbore, comprising:

a body for disposing around a periphery of a downhole tubular, the body having a plurality of bow springs biased toward an expanded position and a pair of end rings connecting the bow springs;

an indentation or row of indentation segments formed in a surface of and along each bow spring and operable to reduce a stiffness of the centralizer as the bow springs move from the expanded position to a restricted position, wherein each indentation or indentation segment is a groove; and a pair of stress reliefs formed through each bow spring, each stress relief extending from a respective end of the respective groove to the respective end ring.

18. A centralizer for use in a wellbore, comprising:

a body for disposing around a periphery of a downhole tubular, the body having a plurality of bow springs biased toward an expanded position and a pair of end rings connecting the bow springs; and an indentation or row of indentation segments formed in a surface of and along each bow spring and operable to reduce a stiffness of the centralizer as the bow springs move from the expanded position to a restricted position, wherein:

the bow springs are further movable to an intermediate deployed position, the centralizer exhibits a first stiffness between the expanded and deployed positions and a second stiffness between the deployed and restricted positions, and the second stiffness is less than or equal to eighty percent of the first stiffness.

19. A centralizer for use in a wellbore, comprising:

a body for disposing around a periphery of a downhole tubular, the body having a plurality of bow springs biased toward an expanded position and a pair of end rings connecting the bow springs; and an indentation or row of indentation segments formed in a surface of, but not through a thickness of, and along a length of each bow spring and operable to reduce a stiffness of the centralizer as the bow springs move from the expanded position to a restricted position, wherein the body is made from steel.

20. A centralizer for use in a wellbore, comprising:

a body for disposing around a periphery of a downhole tubular, the body having a plurality of bow springs biased toward an expanded position and a pair of end rings connecting the bow springs; and an indentation or row of indentation segments formed in a surface of, but not through a thickness of, and along a length of each bow spring and operable to reduce a stiffness of the centralizer as the bow springs move from the expanded position to a restricted position, wherein a cross section (transverse to the length) of each bow spring is convex.

* * * * *